United States Patent [19]

Leupold et al.

[11] Patent Number: 5,075,662

[45] Date of Patent: Dec. 24, 1991

[54] ENHANCED MAGNETIC FIELD WITHIN ENCLOSED ANNULAR CAVITY

[75] Inventors: Herbert A. Leupold, Eatontown; Ernest Potenziani, II, Ocean, both of N.J.

[73] Assignee: The United States of America as represented by the Secretary of the Army, Washington, D.C.

[21] Appl. No.: 436,407

[22] Filed: Nov. 14, 1989

[51] Int. Cl.[5] ..... H01F 7/02

[52] U.S. Cl. ..... 335/306

[58] Field of Search ..... 335/306, 301, 302, 304, 335/296, 297, 298

[56] References Cited

U.S. PATENT DOCUMENTS 3,593,239 7/1971 Hofman .

3,706,059 12/1972 Theyse ..... 335/306

4,004,167 1/1977 Meckling ..... 335/302

FOREIGN PATENT DOCUMENTS 750193 6/1956 United Kingdom ..... 335/302

*Primary Examiner*—Harold Broome

*Assistant Examiner*—Trinidad Korka

*Attorney, Agent, or Firm*—Michael Zelenka; John M. O'Meara

[57] ABSTRACT

The fabrication of a flux source using magnetically rigid material is disclosed for deriving a magnetic field of uniform density and enhanced magnitude within an enclosed annular cavity thereof. In the preferred embodiments, segments of the magnetically rigid material are configured and arranged in accordance with the desired direction of the magnetic field relative to the annular axis of the cavity.

21 Claims, 5 Drawing Sheets

ENHANCED MAGNETIC FIELD WITHIN ENCLOSED ANNULAR CAVITY

The invention described herein may be manufactured, used, and licensed by or for the United States Government for governmental purposes without the payment to us of any royalties thereon.

BACKGROUND OF THE INVENTION

The present invention relates generally to flux sources or permanent magnet structures wherein magnetically rigid (hereinafter MR) materials are utilized to derive high magnitude magnetic fields of uniform flux density in enclosed cavities and more particularly, to such flux sources with annular cavities.

In the electronic arts, magnetic fields are employed in various applications to control the dynamics of charged particles. One such application is electron beam focusing wherein the repelling forces between the beam's electrons is overcome with magnetic fields directed perpendicularly to the path travelled by the beam which is thereby precluded from spreading out. Another such application is found in radiation sources wherein magnetic fields are applied across the path travelled by charged particles to accelerate those particles thereacross in a perpendicular direction. Furthermore, very large magnetic fields are employed in NMR (Nuclear Magnetic Resonance) imagers which have become a very important tool in medical diagnostics.

Because of the massive solenoids and bulky power supplies which are associated therewith, electromagnets present problems in most applications where they are employed to derive magnetic fields. However, before MR material was used for permanent magnet structures, electromagnets were the generally accepted design approach for deriving magnetic field magnitudes of any significance. Such was particularly true when a magnetic field confined within a work space or cavity was desired. This was so because suitable permanent magnet structures require exterior cladding magnets to confine the magnetic field, as well as bucking magnets and pole pieces to preclude flux leakage to the exterior of the structures and conventional magnets do not have sufficient coercivity to serve in these capacities.

SUMMARY OF THE INVENTION

It is the general object of the present invention to provide a flux source of MR material, with which a uniformly high magnetic field within a substantially annular cavity is sustained in any desired direction relative to the annular axis of the cavity.

It is a specific object of the present invention to accomplish the above-stated general object for a magnetic field directed radially relative to the annular axis of the cavity.

It is another specific object of the present invention to accomplish the above-stated general object for a magnetic field directed parallel to the annular axis of the cavity.

It is still another specific object of the present invention to accomplish the above-stated objects with a flux source having a plurality of MR material layers nested therein to further enhance the magnetic field.

These and other objects are accomplished in accordance wit the preferred embodiments of the present invention wherein at least one layer of MR material is utilized to construct the flux source thereof. Each layer is fabricated with circular segments and in some preferred embodiments, annular segments are arranged in each layer to construct a hollow ring or toroidal flux source. Each preferred embodiment requires that the magnetic orientation of each segment be fixed in combination with the magnetic orientations of the other segments to direct the magnetic field in the desired direction relative to the annular axis of the cavity. For still other preferred embodiments, segments having triangular cross-sections are utilized, and the magnetic orientation of each segment is established by the disposition thereof in its layer of MR material relative to the cavity.

The scope of the present invention is limited only by the appended claims for which support is predicated on the preferred embodiments hereinafter set forth in the following description and the attached drawings wherein like reference characters relate to like parts throughout the several figures.

DESCRIPTION OF THE PREFERRED EMBODIMENTS

Figure 1:
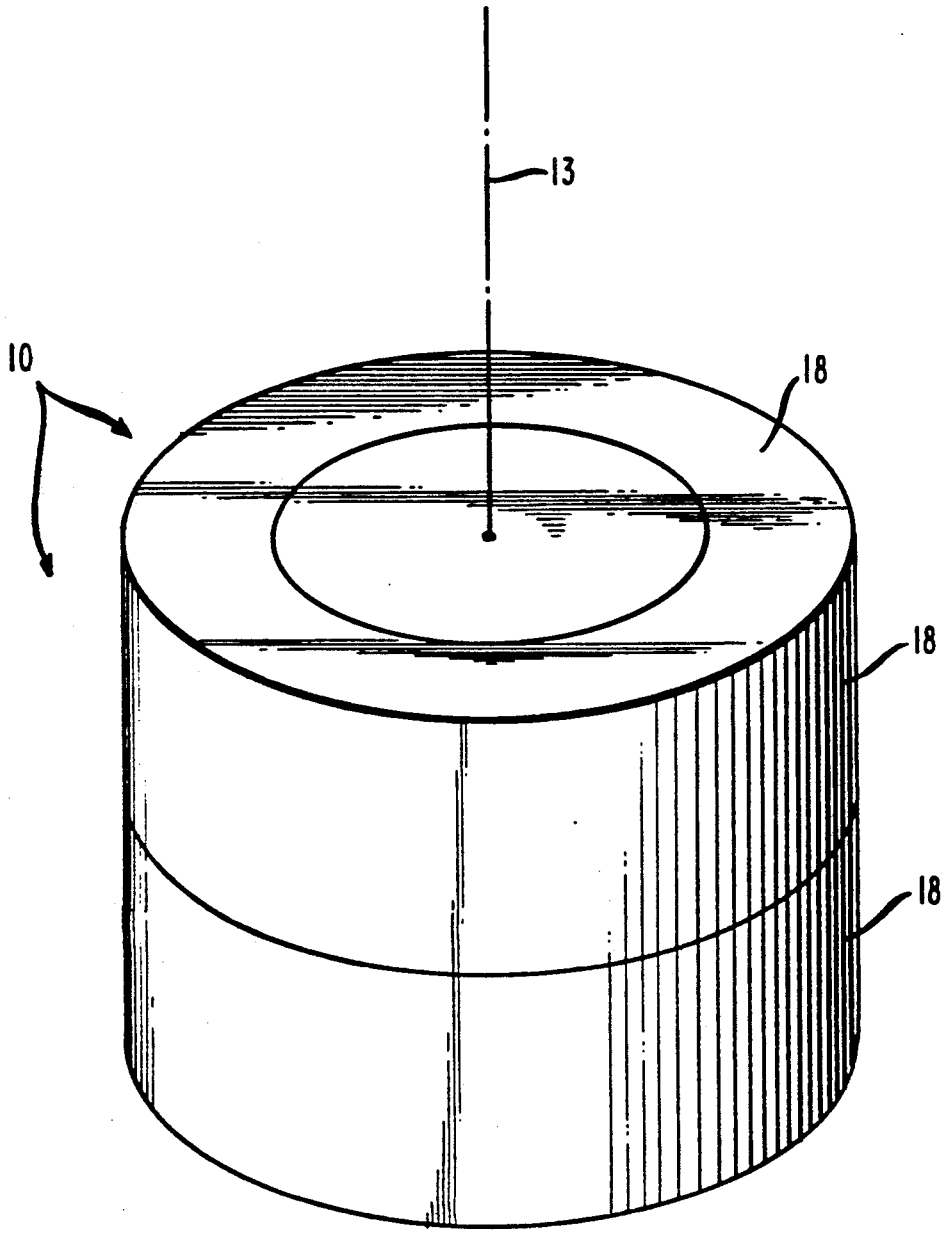
FIG. 1 is an isometric view along the vertical axis of a flux source in accordance with the invention, showing one possible exterior configuration therefor.

A flux source or permanent magnet structure 10 in accordance with the preferred embodiments of the invention, is illustrated in FIG. 1. Within the flux source 10, an enclosed cavity 12 of substantially annular configuration about an axis 13, is disposed as shown in FIGS. 2, 3, 4 and 5. MR material is utilized in the fabrication of the flux source 10 to derive a magnetic field 14 of uniform density and enhanced magnitude in some desired direction relative to the annular axis 13 of the cavity 12, when the MR material is configured and magnetized in accordance with the teachings of this invention.

As is apparent from U.S. Pat. No. 4,837,542 which issued on 6/6/89 to Herbert A. Leupold, a co-applicant hereto, and the publication of K. Halbach referenced in that patent, MR materials are well known to those skilled in the magnetic arts. Some ferrites, for example particular Barium Ferrites, and rare-earth alloys, for example Neodymium-Iron-Boron and Rare Earth Cobalts such as Samarium Cobalt or Cerium Cobalt, have been utilized or are being contemplated for use as MR materials. The most pronounced characteristic of MR materials is their very high coercivity (field magnitude required to demagnetize) relative to that of traditional magnetic materials. This characteristic may be viewed as the means that affords attainment of various magnetic circuit effects which render MR materials distinguishable from traditional magnetic materials, such as field transparency and flux path predictability or confinement. As to the former, external magnetic fields up to some magnitude greater than the remanence (magnetized level) of a MR material will pass therethrough without affecting the magnetic orientation thereof. A resultant field therefore occurs as the vector sum of the external field and the field sustained by the MR material. As to the latter, the magnitude and direction of the magnetization is constant throughout any single piece configuration of MR material, unless an extraordinary magnetizing apparatus and process are utilized therewith, such as disclosed and claimed in application serial number 302,706 which was filed 1/26/89 by Herbert A. Leupold, the present applicant. Therefore, a field source can be constructed of magnetic segments fabricated from MR material, to configure a magnetic circuit as desired and even to completely contain a whole magnetic circuit by confining a magnet field to a cavity.

Figure 2:
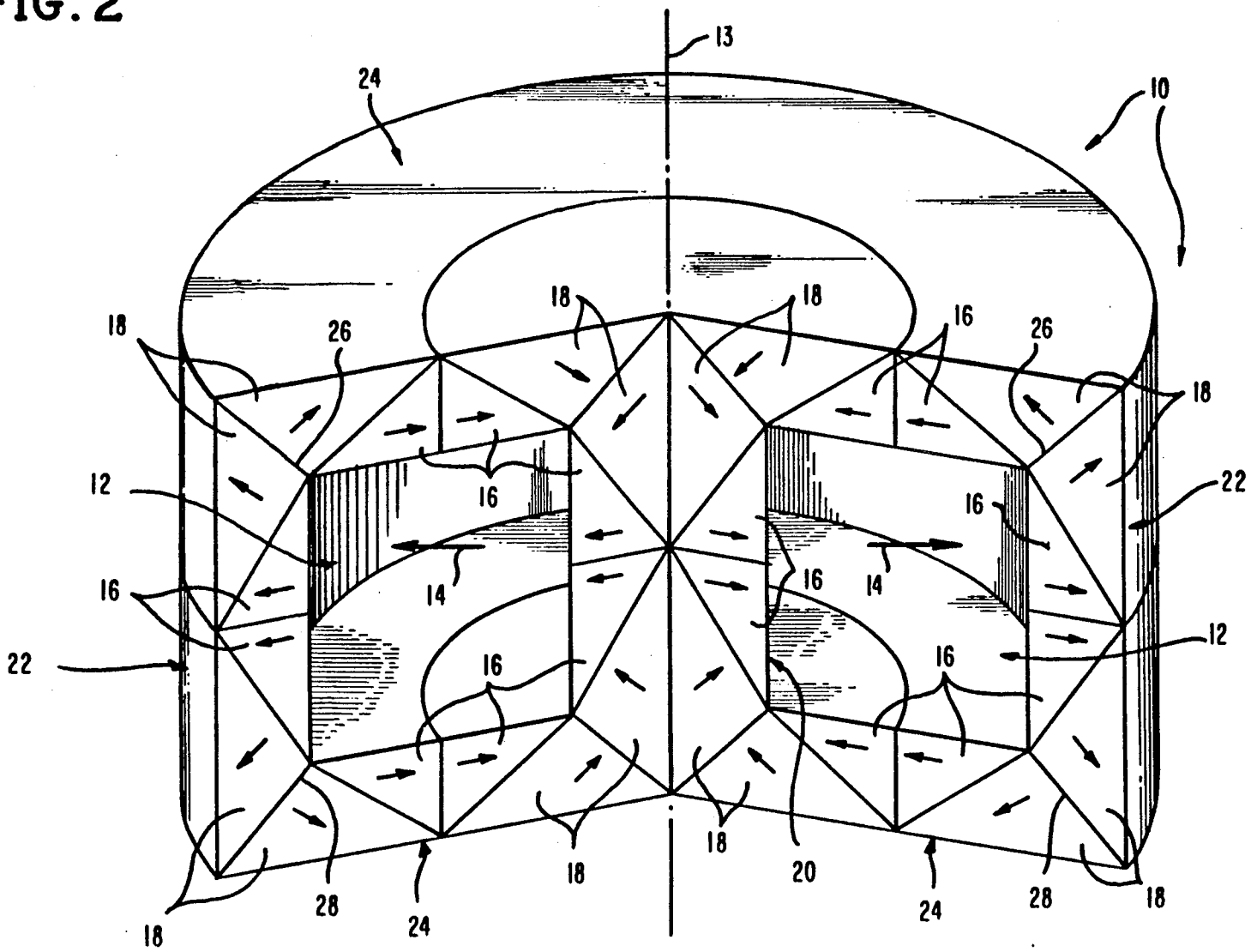
FIG. 2 is a cutaway view of the FIG. 1 flux source, showing the magnetic orientations of individual segments therein which are arranged to direct the magnetic field radially relative to the annular axis of the cavity.
Figure 3:
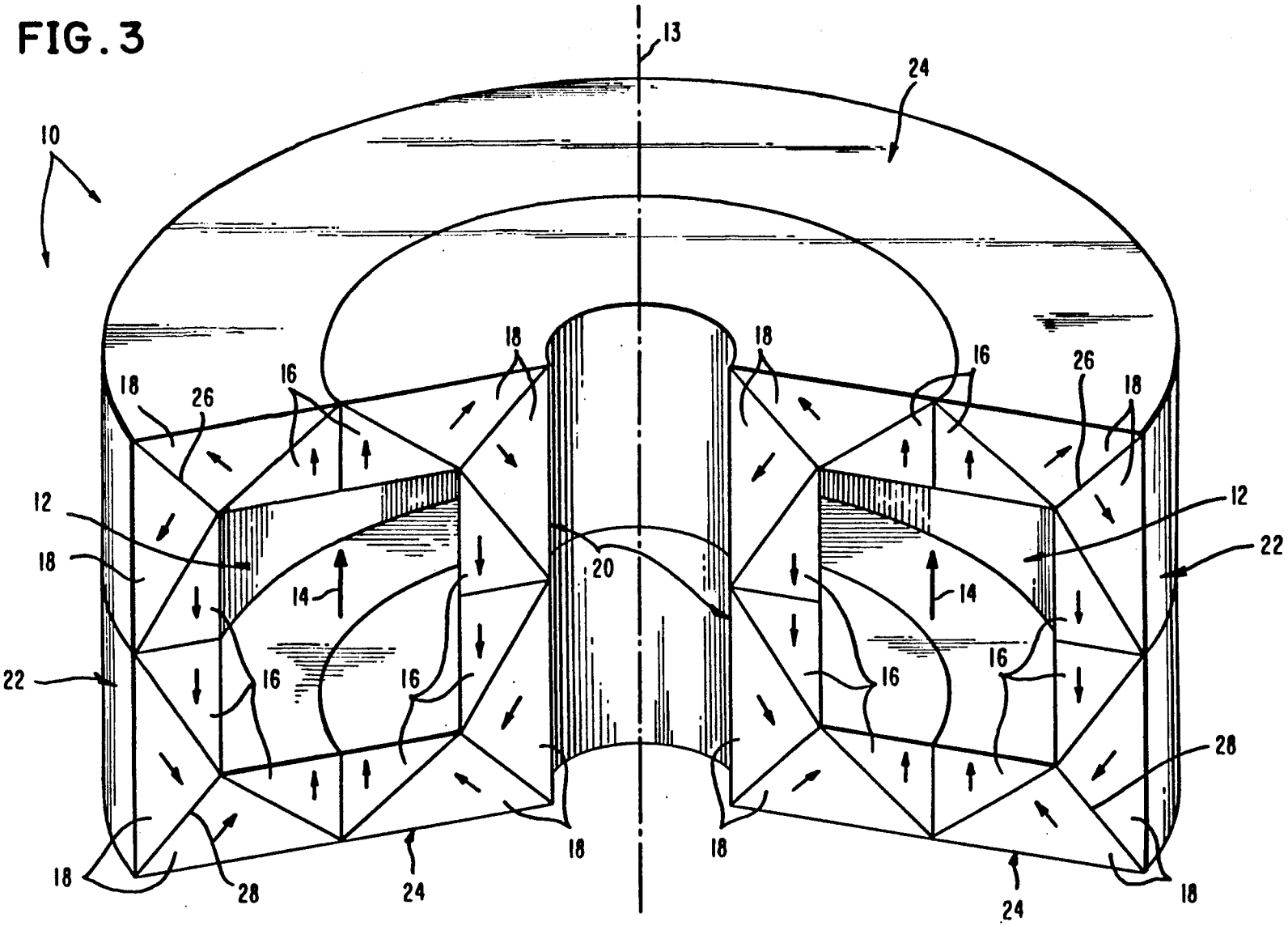
FIG. 3 is a cutaway view of the FIG. 1 flux source, showing the magnetic orientations of individual segments therein which are arranged to direct the magnetic field in parallel with the annular axis of the cavity.

Although it is not yet practical to fabricate the flux source 10 from a single piece of MR material, a plurality of magnetized segments 16 and 18 (identifying numerals to be distinguished hereafter) can be arranged in at least one layer of MR material to construct inner and outer cylinders 20 and 22 respectively, as well as closures 24 extending between the cylinders 20 and 22 at both cylindrical ends thereof, as shown in FIGS. 2 and 3. Each magnetized segment 16 and 18 is fabricated from MR material to have the magnetic orientation represented by the arrow shown therein. The segments 16 and 18 are magnetized and arranged in FIG. 2 for sustaining the magnetic field 14 in a radial direction relative to the axis 13, and in FIG. 3 for sustaining the magnetic field 14 in a direction parallel with the axis 13. However, those skilled in the magnetic arts will certainly understand without any further explanation herein, that segments could magnetized and arranged to direct the magnetic field 14 at any angle relative to the axis 13. Such fabrication could be accomplished with the configuration of each segment 16 or 18 first being obtained by pressing the MR material and then magnetizing that segment 16 or 18 using any of the well know magnetization techniques. Of course, each segment 16 and 18 is magnetized in the direction of the arrow therein. Furthermore, even though the arrows of adjacent segments 16 and 18 are not in exactly the same direction, the magnetic circuit passes between such segments substantially through only the interface therebetween, due to the flux confinement effect of the configuration. Consequently, the magnetic circuit does not leave the bounds of segments 16 and 18, except when it passes through the cavity 12 to develop the magnetic field 14 therein and unnecessary magnetic losses are thereby precluded. It should also be realized without further explanation herein that the inner cylinder 20 can be either solid or hollow about the axis 13 as shown in FIGS. 2 and 3 respectively, depending on the design parameters of the cavity 12 and the magnetic field 14.

Although magnetized segments having other exterior configurations could be utilized in various embodiments of the invention, only segments having substantially circular configurations about the annular axis 13 are disclosed herein. The magnetized segments 16 and 18 must be properly interfaced within the flux source 10 and to insure such interfacing, interfitting magnetized segments are utilized in the preferred embodiments of the invention. Magnetized segments 16 and 18 with substantially triangular cross-sectional configurations can be precisely configured and easily arranged to provide such interfitting, as shown in FIGS. 2 and 3. Also, the triangular cross-sectional configuration generally facilitates the fabrication of the magnetized segments, while precise dimensions for such magnetized segments are readily discernible.

Those skilled in the magnetic arts will certainly understand without any further explanation herein, that within the scope of this invention, the magnetic segments in each MR material layer could be configured and disposed in many different ways. However, each magnetized segments 16 and 18 in the preferred embodiments of FIGS. 2 and 3 is disposed within its MR material layer to either bound (segments 16) or not bound (segments 18) the cavity 12. Of course, because the flux source 10 of FIG. 3 is constructed with only annularly shaped segments in one layer of MR material, the non-bounding magnetized segments 18 therein do bound the flux source 10. The closures 24 for each MR material layer are individually interfaced with the cylinders 20 and 22 for each layer, along separate boundaries 26 and 28 between at least one non-bounding magnetized segment 18 in the closure 24 and at least one non-bounding magnetized segment 18 in the cylinders 20 and 22. The magnetic orientation of each cavity bounding magnetized segment 16 is aligned parallel to the magnetic field 14, with the magnetic orientations of the cavity bounding magnetized segments 16 in the cylinders 20 and 22 of each layer being oppositely directed relative to the magnetic orientations of the cavity bounding magnetized segments 16 in the closures 24 of each layer. Each non-bounding magnetized segment 18 is interfaced with at least one other non-bounding magnetized segment 18 along one of the boundaries 26 and 28, with its magnetic orientation aligned perpendicularly relative to the magnetic orientation of those other non-bounding magnetized segments 18. The directions assigned t the magnetic orientations of the magnetized segments 16 and 18 in the cylinders 20, 22 and the closures 24 are of course determined in accordance with the desired direction of the magnetic field 14 relative to the annular axis 13 of the cavity 12.

For the magnetic field 14 to be directed radially relative to the annular axis 13 of the cavity 12, the magnetic orientations of the magnetized segments 16 and 18 would be directed, as shown in FIG. 2. In the cylinders 20 and 22, the magnetic orientations of the cavity bounding magnetized segments 16 would be directed at an angle of 0 degrees relative to the direction of the magnetic field 14, while the magnetic orientations of each non-bounding magnetized segment 18 would generally be in the same direction as the magnetic field 14 and parallel to the boundary 26 or 28 along which that segment interfaces with at least one non-bounding magnetized segments 18 in the closures 24. As for the closures 24, the magnetic orientations of the cavity bounding magnetized segments 16 would be directed at an angle of 180 degrees relative to the direction of the magnetic field 14, while the magnetic orientations of each non-bounding magnetized segment 18 would generally be opposite in direction to the magnetic field 14 and perpendicular to the boundary 26 or 28 along which that segment interfaces with at least one non-bounding magnetized segments 18 in the cylinders 20 and 22.

For the magnetic field 14 to be directed in parallel with the annular axis 13 of the cavity 12, the magnetic orientations of the magnetized segments 16 and 18 would be directed, as shown in FIG. 3. In the cylinders 20 and 22, the magnetic orientations of the cavity bounding magnetized segments 16 would be directed at an angle of 180 degrees relative to the direction of the magnetic field 14, while the magnetic orientations of each non-bounding magnetized segment 18 would generally be opposite in direction to the magnetic field 14 and perpendicular to the boundary 26 or 28 along which that segment interfaces with at least one non-bounding magnetized segments 18 in the closures 24. As for the closures 24, the magnetic orientations of the cavity bounding magnetized segments 16 would be directed at an angle of 0 degrees relative to the direction of the magnetic field 14, while the magnetic orientations of each non-bounding magnetized segment 18 would generally be in the same direction as the magnetic field 14 and parallel to the boundary 26 or 28 along which that segment interfaces with at least one non-bounding magnetized segments 18 in the cylinders 20 and 22.

Magnetized segments 16 and 18 having mirror image crosssectional configurations and magnetic orientations are located on each side of the cavity's annular axis 13 at symmetrically analogous locations in the flux source 10 of FIGS. 2 and 3. Therefore, those segments 16 and 18 at the symmetrically analogous locations across the axis 13 may be consolidated into a single magnetized segment having a substantially circular configuration about axis 13 and throughout 360 degrees, to facilitate the fabrication thereof.

Figure 4:
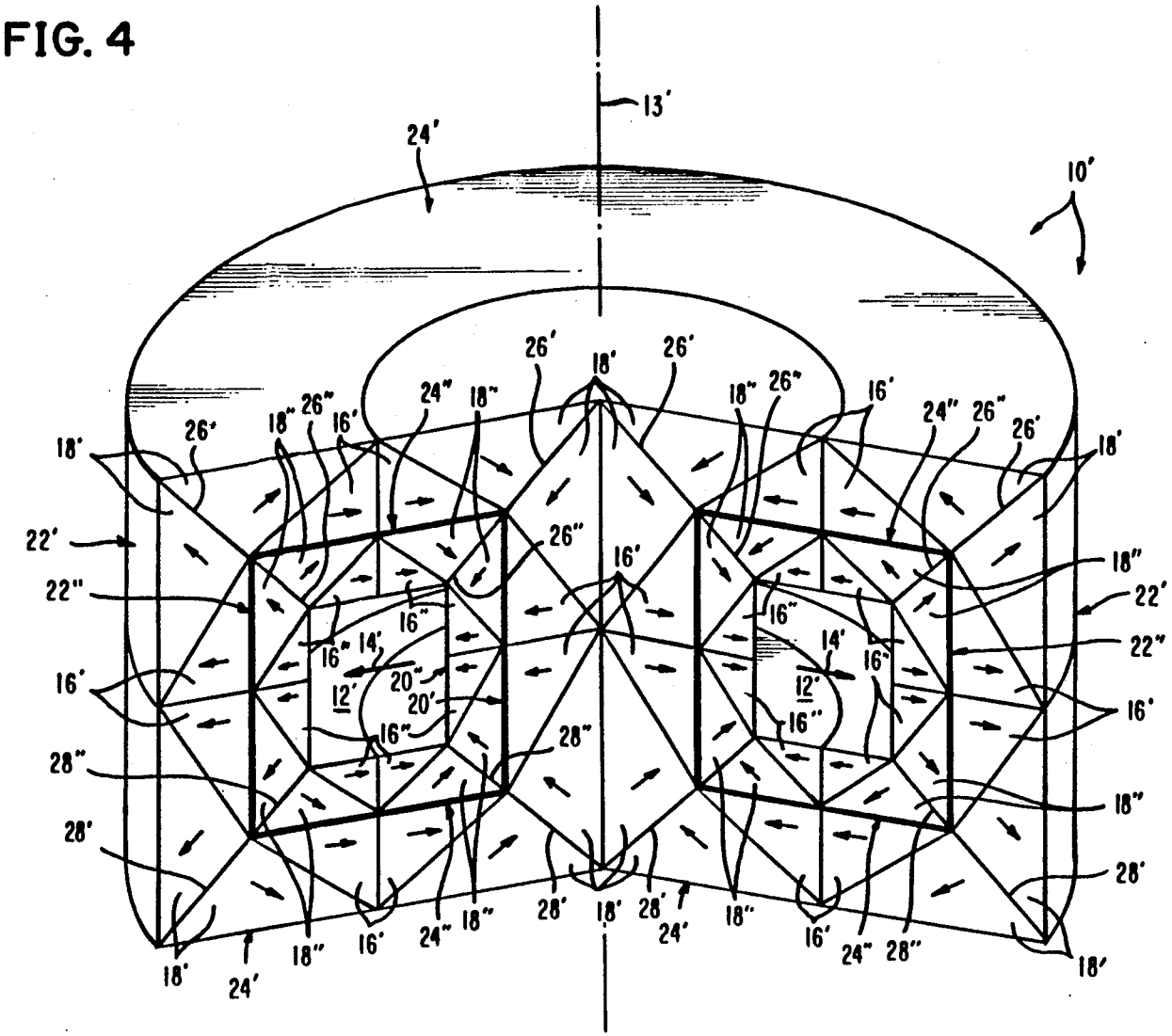
FIG. 4 is a cutaway view of the FIG. 1 flux source, which is similar to FIG. 2 but shows the individual segments arranged in plurality of nested MR material layers.
Figure 5:
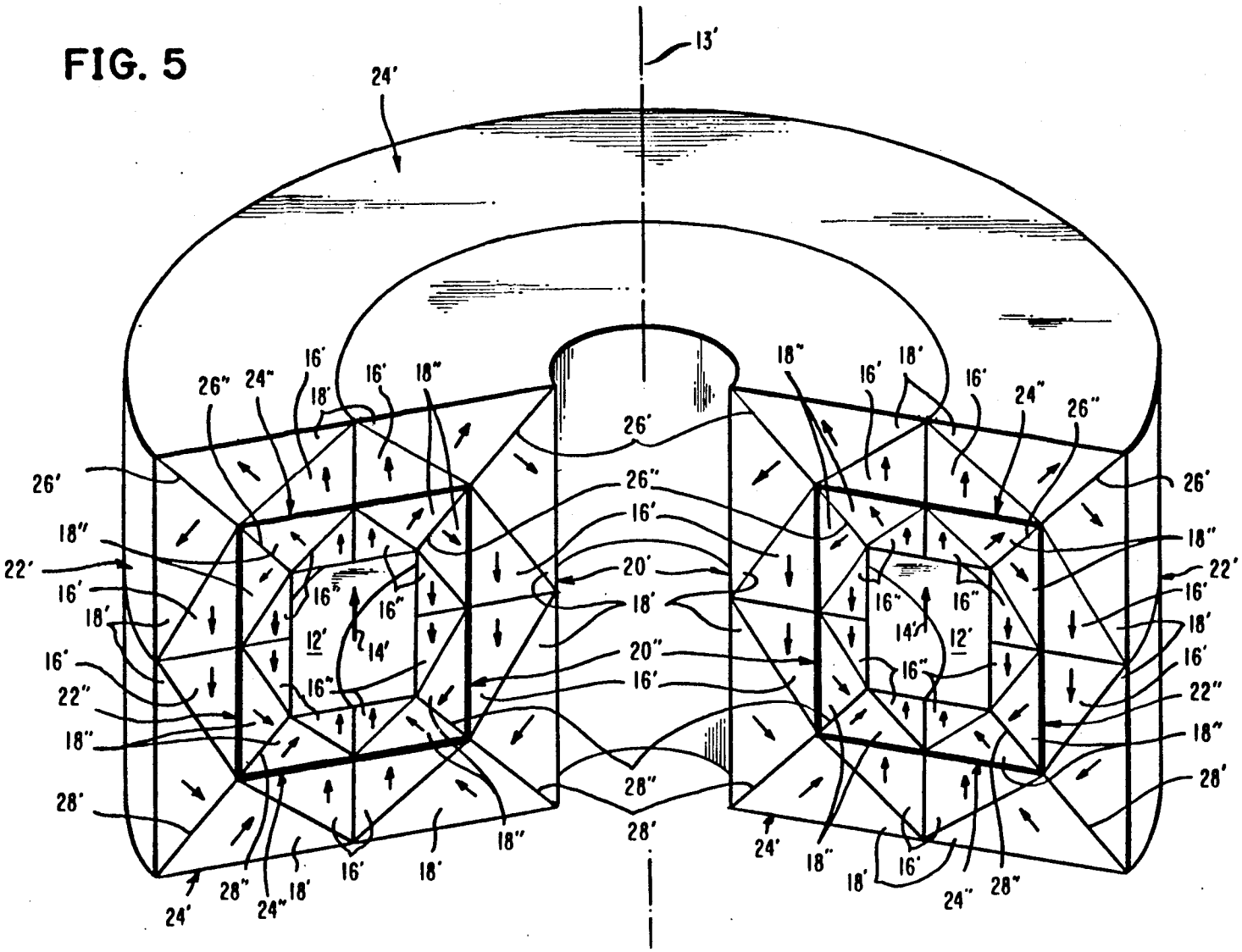
FIG. 5 is a cutaway view of the FIG. 1 flux source, which is similar to FIG. 3 but shows the individual segments arranged in a plurality of nested MR material layers.

As shown for the flux sources 10' in FIGS. 4 and 5, the MR material can be disposed in a plurality of layers to further enhance the magnitude of the magnetic field 14' within the annular cavity 12' thereof. Of course, each MR material layer is constructed from a plurality of magnetized segments 16', 18' and 16'', 18', respectively, which for the sake of discussion only are configured and arranged in the same manner as discussed above regarding FIGS. 2 and 3. Consequently, the layers include cylinders 20', 20'', and 22', 22'' respectively, as well as closures 24' and 24'', respectively, extending between the cylinders 20', 20'', and 22', 22''. The inner layer is "nested" within the outer layer so that the outer dimensions of the inner layer are substantially equal to the inner dimensions of the outer layer and heavy lines are utilized to illustrate this in FIGS. 4 and 5. Furthermore, when all of the analogous dimensions for the adjacent layers are in the same proportion, each layer contributes equally to the magnitude of the magnetic field 14' within the cavity 12'. The individual contributions of the layers add vectorially to produce the magnetic field 14' in a direction relative to the annular axis 13' of the cavity 12'. To optimize the uniformity and maximize the resulting vector magnitude of the magnetic field 14', cylinders 20', 20'', and 22', 22'' are coaxially aligned about the axis 13', while the closures 24' and 24', are arranged in parallel and aligned perpendicularly across the axis 13'. Certainly, it will be understood without further explanation herein that the magnetic orientations of the magnetized segments 16', 18' and 16'', 18'', respectively in each MR material layer would also be determined in accordance with the desired direction of the magnetic field 14' relative to the annular axis 13' of the cavity 12', as explained previously in regard to FIGS. 2 and 3. Furthermore, each magnetized segment 16', 18' and 16'', 18'' in the preferred embodiments of FIGS. 4 and 5 is disposed to bound its MR material layer in either a near (segments 16' and and 16'') or far (segments 18' and 18'') plane relative to the cavity 12, Those skilled in the art of permanent magnets will appreciate without any further explanation that within the flux source construction concept of this invention, many modifications and variations are possible to the above disclosed embodiments. Consequently, it should be understood that all such modifications and variations fall within the scope of the following claims.

What is claimed is:

1. In a flux source of the type having a substantially annular enclosed cavity wherein a magnetic field is sustained, the improvement comprising:

said flux source being fabricated of magnetically rigid material in a plurality of magnetized segments to sustain said magnetic field with uniform density and enhanced magnitude in some desired direction relative to the annular axis of said cavity, and said magnetized segments being configured and arranged to construct inner and outer cylinders, as well as closures extending between the ends of both said cylinders.

2. The flux source of claim 1 wherein said magnetized segments are further configured and arranged to be interfitting within said flux source.

3. The flux source of 1 wherein said cavity is bound by some said magnetized segment and not bound by other said magnetized segments.

4. The flux source of claim 3 wherein each said closure is interfaced with said cylinders along a boundary between at least one said non-bounding magnetized segment in said closure and at least one said non-bounding magnetized segment in said cylinders.

5. The flux source of claim 4 wherein the magnetic orientations of said cavity bounding magnetized segments are aligned parallel to said magnetic field with those in said cylinders being oppositely directed relative to those in said closures, each said non-bounding magnetized segment being interfaced with at least one other non-bounding magnetized segment along one of said boundaries and having its magnetic orientation aligned perpendicularly relative to the magnetic orientation of those other said non-bounding magnetized segments, and the directions of the magnetic orientations for said magnetized segments in said cylinders and said closures are determined in accordance with the desired direction of said magnetic field relative to the annular axis of said cavity.

6. The flux source of claim 5 wherein the magnetic orientations of said cavity bounding magnetized segments in said cylinders are directed at an angle of 180 degrees relative to said magnetic field, the magnetic orientations of said cavity bounding magnetized segments in said closures are directed at an angle of 0 degrees relative to said magnetic field, the magnetic orientation of each said non-bounding magnetized segment in said cylinders is directed generally opposite to said magnetic field and perpendicular to said boundary along which that segment interfaces with said non-bounding magnetized segments in said closures, and the magnetic orientation of each said non-bounding magnetized segment in said closures is directed generally the same as said magnetic field and parallel to said boundary along which that segment interfaces with said non-bounding magnetized segments in said cylinders.

7. The flux source of claim 4 wherein the magnetic orientations of said cavity bounding magnetized segments in said cylinders are directed at an angle of 0 degrees relative to said magnetic field, the magnetic orientations of said cavity bounding magnetized segments in said closures are directed at an angle of 180 degrees relative to said magnetic field, the magnetic orientation of each said non-bounding magnetized segment in said cylinders is directed generally the same as said magnetic field and parallel to said boundary along which that segment interfaces with said non-bounding magnetized segments in said closures, and the magnetic orientation of each said non-bounding magnetized segment in said closures is directed generally opposite to said magnetic field and perpendicular to said boundary along which that segment interfaces with said non-bounding magnetized segment in said cylinders.

8. In a flux source of the type having a substantially annular enclosed cavity wherein a magnetic field is sustained, the improvement comprising:

said flux source being fabricated of magnetically rigid material in a plurality of magnetized segments to sustain said magnetic field with uniform density and enhanced magnitude in some desired direction relative to the annular axis of said cavity, said magnetized segments being configured and arranged to construct inner and outer cylinders, as well as closures extending between the ends of both said cylinders and the configuration of each said magnetized segment being substantially circular.

9. The flux source of claim 8 wherein the substantially circular configuration of each said magnetized segment is substantially annular.

10. The flux source of claim 8 wherein the cross-sectional configuration of said magnetized segments is substantially triangular.

11. In a flux source of the type having a substantially annular enclosed cavity wherein a magnetic field is sustained, the improvement comprising:

said flux source being fabricated of magnetically rigid material to sustain said magnetic field with uniform density and enhanced magnitude in some desired direction relative to the annular axis of said cavity, and said magnetically rigid material is disposed in a plurality of nested layers.

12. The flux source of claim 11 wherein a plurality of magnetized segments fabricated from said magnetically rigid material are configured and arranged in each said layer to construct coaxial inner and outer cylinders, as well as closures extending between the ends of both said cylinders.

13. The flux source of claim 12 wherein the configuration of each said magnetized segment is substantially circular.

14. The flux source of claim 13 wherein the substantially circular configuration of each said magnetized segment is substantially annular.

15. The flux source of claim 12 wherein said magnetized segments are further configured and arranged to be interfitting within each said layer.

16. The flux source of claim 15 wherein the cross-sectional configuration of said magnetized segments is substantially triangular.

17. The flux source of claim 12 wherein each said layer includes a near plane and a far plane relative to said cavity, with said near plane being bound by some said magnetized segments and said far plane being bound by other said magnetized segments.

18. The flux source of claim 17 wherein each said layer is structured with its said closures being individually interfaced with its said cylinders along a boundary between at least one said far plane magnetized segment in said closure and at least one said far plane magnetized segment in said cylinder.

19. The flux source of claim 18 wherein each said layer has the magnetic orientations of its said inner plane magnetized segments aligned parallel to said magnetic field with those in its said cylinders being oppositely directed relative to those in its said closures, while each of its said far plane magnetized segments is interfaced with at least one other far plane magnetized segment along one of said boundaries with the magnetic orientations of such interfacing segments being aligned perpendicularly relative to each other, and the directions of the magnetic orientations for said magnetized segments in its said cylinders and said closures are determined in accordance with the desired direction of said magnetic field relative to the annular axis of said cavity.

20. The flux source of claim 19 wherein each said layer has the magnetic orientations of said near plane magnetized segments in its said cylinders directed at an angle of 180 degrees relative to said magnetic field, the magnetic orientations of said near plane magnetized segments in its said closures directed at an angle of 0 degrees relative to said magnetic field, the magnetic orientation of each said far plane magnetized segment in its said cylinders directed generally opposite to said magnetic field and perpendicular to said boundary along which that segment interfaces with said far plane magnetized segments in said closures, and the magnetic orientation of each said far plane magnetized segment in its said closures directed generally the same as said magnetic field and parallel to said boundary along which that segment interfaces with said far plane magnetized segments in said cylinders.

21. The flux source of claim 19 wherein each said layer has the magnetic orientations of said near plane magnetized segments in its said cylinders directed at an angle of 0 degrees relative to said magnetic field, the magnetic orientations of said near plane magnetized segments in its said closures directed at an angle of 180 degrees relative to said magnetic field, the magnetic orientation of each said far plane magnetized segment in its said cylinders directed generally the same as said magnetic field and parallel to said boundary along which that segment interfaces with said far plane magnetized segments in said closures, and the magnetic orientation of each said far plane magnetized segment in its said closures directed generally opposite to said magnetic field and perpendicular to said boundary along which that segment interfaces with said far plane magnetized segments in said cylinders.

* * * * *